US005288082A

United States Patent [19]

Marquez

[11] Patent Number: 5,288,082

[45] Date of Patent: Feb. 22, 1994

[54] METHOD OF PLAYING DOUBLE HAND MARQUEZ

[76] Inventor: Ruben L. Marquez, 5134 Pattijo Dr., Carmichael, Calif. 95608

[21] Appl. No.: 44,282

[22] Filed: Apr. 7, 1993

[51] Int. Cl.[5] ..... A63F 1/00

[52] U.S. Cl. ..... 273/292

[58] Field of Search ..... 273/292, 274, 309, 854

[56] References Cited

U.S. PATENT DOCUMENTS

| | | | |
|---|---|---|---|
| 821,781 | 5/1906 | Cadwallader | 273/304 |
| 2,006,521 | 7/1935 | Stone | 273/292 |
| 4,397,469 | 8/1983 | Carter, III | 273/149 R |
| 4,659,087 | 4/1987 | Shen et al. | 273/274 |
| 5,013,049 | 5/1991 | Tomaszewski | 273/292 |
| 5,154,429 | 10/1992 | LaVasseur | 273/292 |
| 5,174,579 | 12/1992 | Griffiths | 273/292 |

OTHER PUBLICATIONS

"Wisted's California Aces: The Game of the 21st Century"; Nov. 13, 1992; The Card Player vol. 5, No 23.

"Multiple Action Blackjack 1, 2, 3"; Nov. 1992; Casino Player.

Scarne's Encyclopedia of Games by John Scarne, Harper & Row, Publishers, 1973, p. 281.

WIN magazine, Apr. 1992, pp. 39, 40 and 70.

*Primary Examiner*—Benjamin H. Layno

*Attorney, Agent, or Firm*—John P. O'Banion; John Costello

[57] ABSTRACT

A multiple hand variation of the card game Twenty-One involving individual players being dealt five cards, the five cards being divided into a two-card front hand and a three-card back hand is disclosed. The cards in the front hand and the cards in the back hand are arranged to as to make the each hand have a numerical value as close to twenty-one as possible, without going over, while at the same time maximizing the value of the front hand in relation to the back hand so that the front hand has a numerical value closer to twenty-one, without exceeding twenty-one, than the back hand. The front hand and the back hand of a player is compared against the front hand and the back hand of a bank player, respectively, to determine if the player wins the hand, in which case the bank player pays the player, or if the player loses the hand, in which case the player forfeits its wager for the hand, or there is a tie.

20 Claims, 2 Drawing Sheets

METHOD OF PLAYING DOUBLE HAND MARQUEZ

BACKGROUND OF THE INVENTION

1. Field of the Invention

This invention pertains generally to a method of playing a card game, and more particularly to a method of playing a modified version of Twenty-One, wherein multiple players simultaneously play a front hand and a back hand, the front hand having one less card than the back hand, with the object of arranging the cards in both hands to come as close to twenty one as possible, without exceeding twenty one, while at the same time maximizing the value of the front hand.

2. Description of the Background Art

The game of "Twenty-One" has been a staple in most casinos worldwide for a number of years. The objective of Twenty-One is to have a hand where the sum of the designated values of each card in the hand comes as close to the number twenty one, without exceeding it. The hand which equals, or achieves the sum closest to twenty one, without going over, is designated the winning hand. Losing hands are deemed to be all hands having a lesser sum than the winning hand, and all hands which exceed the sum of twenty-one. It is also possible to have tying hands in the game of Twenty-One.

The conventional method of playing Twenty-One involves one or more players competitively wagering their hands against the hand of a dealer. In Twenty-One, a standard deck of playing cards is used where the cards are assigned the following point values: King, Queen, Jack—10; Ace—1 or 11 depending on which value is most beneficial to the card hand; 2 through 10—their numerical value. After placing wagers, the players are initially dealt two cards face-up and the dealer is also dealt two cards, one face-up and one face-down. The players must next gauge their chances of beating the dealer's hand based upon the values showing on their two cards and the value showing upon the dealer's face-up card. At this point, the players may take additional cards from the dealer until either they choose to "stand" or else until the sum of all their cards exceeds twenty-one. The dealer may then reveal his face-down card and take additional cards, depending on the rules of the casino. Upon comparison, if the player's sum is higher than the dealer's sum, without exceeding twenty one, the player wins and collects from the dealer. If the player's sum equals the dealer's sum, a tie is declared and the player keeps his wager, but also does not collect from the dealer. If the player's sum is less than the dealer's, or else exceeds twenty one, the player loses and must surrender his wager to the dealer.

The conventional rules of playing Twenty-One as previously described, have been subjected to many variations, depending usually upon the customs or rules of the casino in which the game is played, or else upon the demand for a particular variation imposed by the players. Most of these variations involve modifications upon the conventional method of playing Twenty-One where the dealer's single hand competes against the player's single hand.

However, variations of the game of Twenty-One involving play with multiple hands, are also known. One well known multiple-hand variation is known as "splitting pairs", where if the player's first two cards dealt comprise a pair, the player may split the pair into two separate hands, where each card of the original pair serves as the original card of each hand. The player may then play each card of the original pair as separate hands according to the conventional rules of Twenty-One.

U.S. Pat. No. 5,154,429 issued to LaVasseur on Oct. 13, 1992, discloses another multiple-hand variation of twenty-one, where the dealer plays two or more twenty-one hands, against each player's individual, single hand. The dealer's first card is turned face-up and the players may place a first, second, third, or additional bet. The dealer plays his first hand against the singular hands of the players, and winning players' wagers are paid and losing players' wagers are collected, but only relative to the players' first bet. The dealer then discards his first hand except for his original face-up card, and then using the face-up card, the dealer deals himself a second hand according to the conventional manner of playing Twenty-One. The dealer's second hand is then compared to each player's original first hand. Again, winning players' wagers are paid and losing players' wagers are collected, but only relative to the players' second bet. This multiple hand variation can then be played for as many rounds as the players or dealer desire.

U.S. Pat. No. 5,013,049 issued to Tomaszewski on May 7, 1991, discloses a modified Version of twenty-one where a player and dealer each are dealt five cards from a deck of 54 cards which comprises a standard deck plus two Jokers. Each Joker has a numerical value of 7, face cards and 10's count as zero, Aces count as one and all other cards have their ordinary value. The player may discard and draw up to two cards, while the dealer must discard and draw cards based on preestablished criteria. The player and the dealer then play upon their individual, single, hands. Between the player and the dealer, whoever has a three-card combination closest to twenty-one, without going over, wins the hand. In the event of a tie, the tie is broken by ranking the hand according to the particular cards which add up to twenty one.

U.S. Pat. No. 5,174,579 issued to Griffiths on Dec. 29, 1992, discloses a modified method of playing twenty-one in which an additional wager is added to a conventional Twenty-One game, the additional wager being placed on whether the dealer will bust his or her hand or will achieve a hand of exactly twenty-one. The rules of the game are conventional in all other respects.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

By way of example and not of limitation, the present invention generally pertains to a multiple-hand variation of Twenty-One, wherein the multiple hands are played simultaneously. The game is typically played by two to ten players, one of whom is designated as a "bank player" according to a predetermined set of criteria, and the bank player fronts a sum of money to cover the wagers made by the other players. A non-playing dealer can be used, or one of the players, including the bank player, can be the dealer.

According to the present invention, five cards are dealt to each player. Next, each player divides the five cards into a two-card hand which equals twenty one or comes as close to twenty one as possible, and into a three-card hand made up of the remaining cards. The two-card hand, which comprises the better of the two hands, is designated as the "front" hand and is positioned in front of the three-card hand which is designated the "back" hand. In this regard, the two-card front hand must be maximized in relation to the back hand so as to comprise the better of the player's two hands, even if the result is that the back hand exceeds twenty one. An exception to this rule is what is called a "reverse" hand. In those special circumstances where, regardless of how the five cards are arranged, the three-card hand will have a larger value than the two-card hand (without exceeding twenty-one), the three-card hand is placed in front.

The two hands are then played according to either standard or modified rules of Twenty-One, with the players competitively wagering their front and back hands against the front and back hands of the bank player, respectively.

An object of the invention is to provide a variation of the card game Twenty-One wherein multiple hands having multiple bets can be played simultaneously.

Another object of the invention is to provide a variation of the card game Twenty-One wherein two hands are divided into a hand having a greater number of cards and a hand having a lesser number of cards.

Another object of the invention is to provide a variation of the card game Twenty-One wherein the cards in two hands are arranged so as to make the hand having the lesser number of cards the better hand.

Still another object of the invention is to provide a variation of the card game Twenty-One wherein a bank player wagers multiple card hands against the multiple card hands played by a plurality of players.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
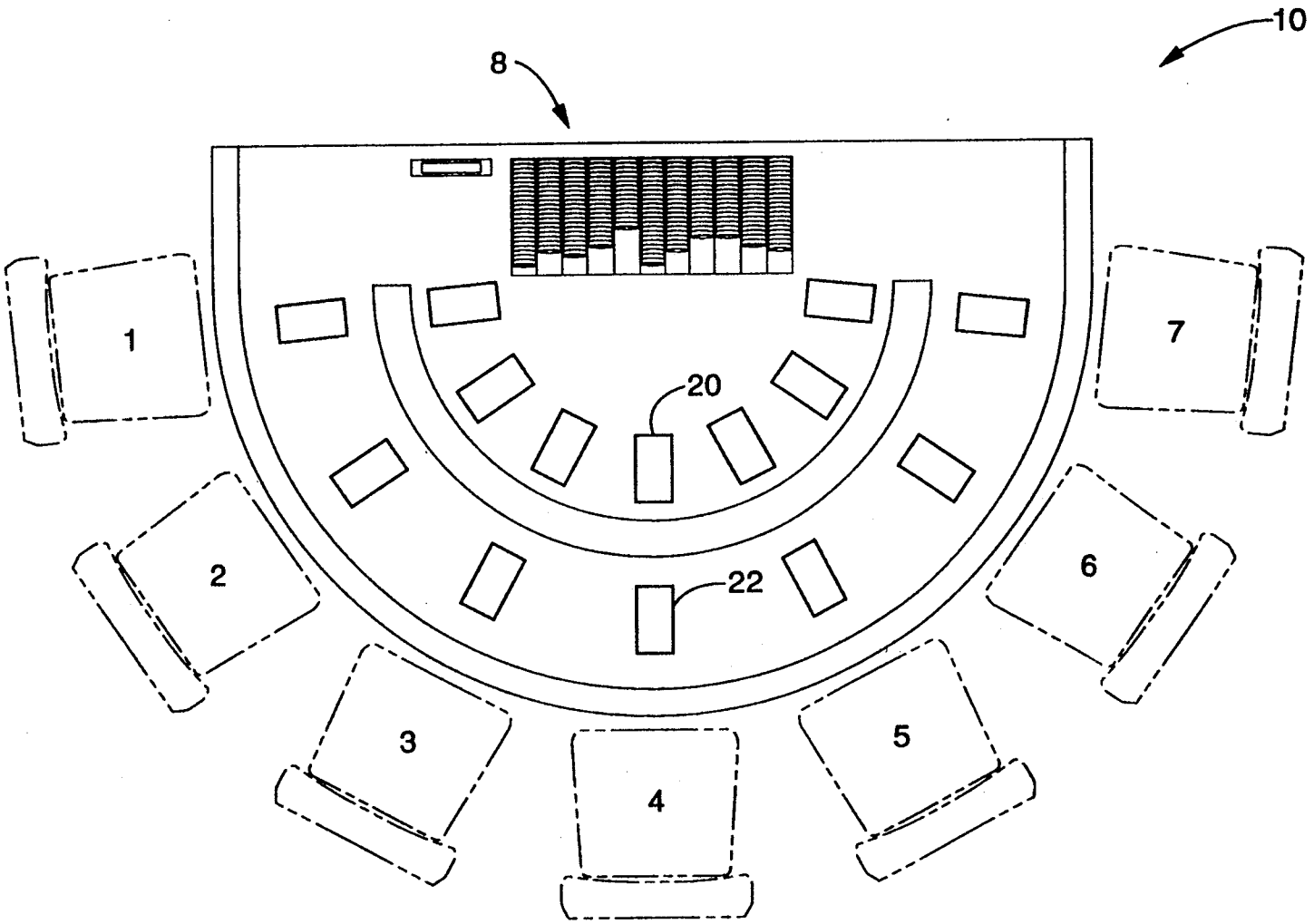
FIG. 1 is a plan view of a typical table used for playing the game of the present invention, showing the placement of seven players, including a bank player.
Figure 3:
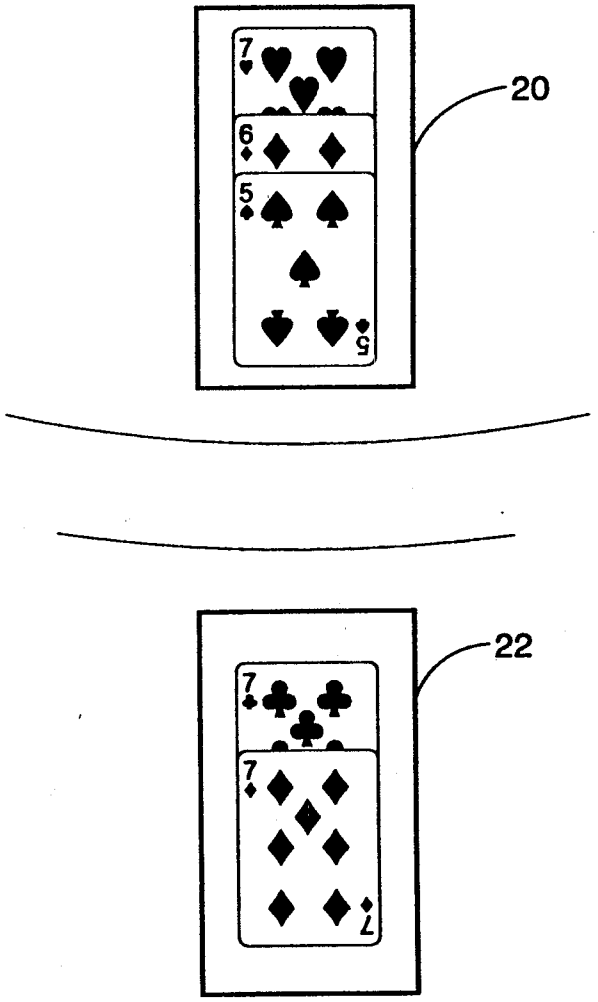
FIG. 3 is a diagrammatic plan view of a reverse hand in play during a game of the present invention.
Figure 2:
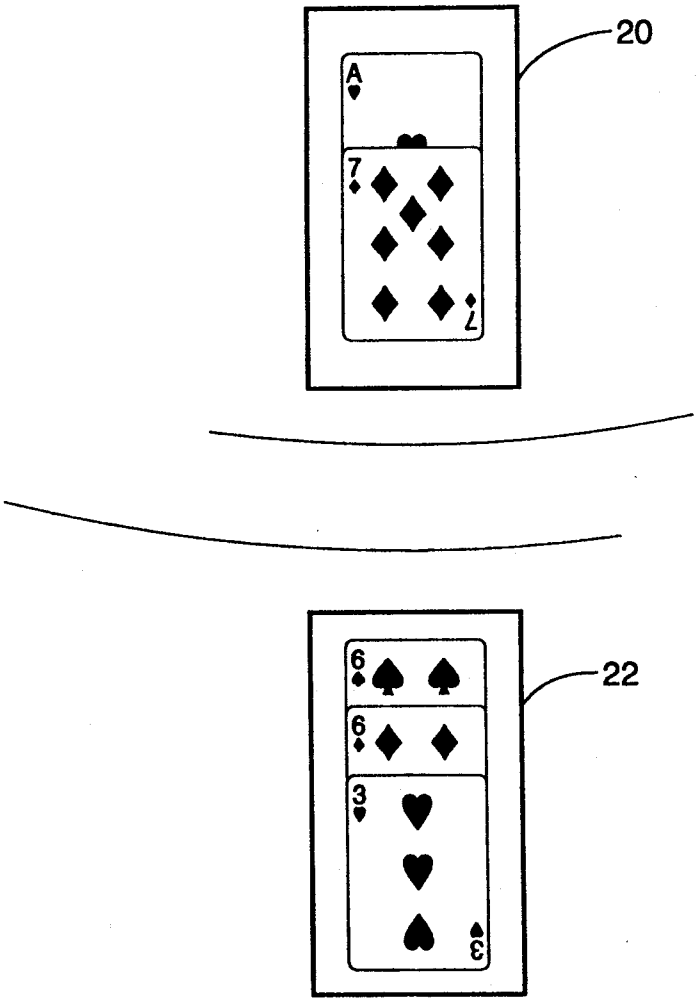
FIG. 2 is a diagrammatic plan view of a typical pair of hands in play during a game of the present invention.

The method of playing the game of the present invention is described herein with reference to FIG. 1 through FIG. 3 which are presented for illustrative purposes. It will be appreciated that the method of playing the game of the present invention may vary as to the particular steps and their sequence without departing from the basic concepts as disclosed herein.

Referring to FIG. 1, a gaming table 10 configured for playing the game "Double Hand Marquez" of the present invention is depicted. The table 10 shown is for illustrative purposes only and is not meant to impose limits on the types of table configurations, variations of Double Hand Marquez which can be played, number of players playing the game, or the format, media, or dimension to which the game of Double Hand Marquez could be adapted.

The table 10 shown in FIG. 1 has positions for seven players, although the game can be played by two to ten players with one or more fifty-two card decks. For illustrative purposes, FIG. 1 shows a bank player at position 2. In the card room embodiment of the game shown in FIG. 1, the dealer at position 8 is not an active player. However, in a casino embodiment, the dealer would typically be an active player as well as the bank player. The game of Double Hand Marquez could be adapted to playing any multitude of hands, but practically, it has been found that play involving two hands is preferable and hence, in FIG. 1, the table 10 shown is configured for two-hand play, wherein a front hand is designated by front position 20 and a rear hand is designated by rear position 22. The object of Double Hand Marquez is to make two hands, the front hand and the rear hand, as close to twenty one as possible, without going over, while at the same time maximizing the value of the front hand in relation to the back hand so that the front hand comprises the better of the two hands, even if that means that the back hand exceeds twenty one. When any player, makes twenty one points on both the front and the back hands at the same time, this combination will be called a "Marquez Double Hand". A Marquez Double Hand will guarantee the player at least a tie in both bets.

In typical play, players 1 through 7 in FIG. 1 would be dealt five cards each. While an even number of cards could be dealt, or more than five cards be dealt, in the preferred embodiment the number of cards dealt is five. The players then arrange their cards into a two-card hand which is placed in front position 20, and a three-card hand which is placed in back position 22. The arranging of the front and back hands is done simultaneously upon the player receiving his five cards, with the two-card front hand always being the better of the two hands. With regards to the wagers placed upon each of the player's pair of hands, the wagers can be of an equal amount, but if they are not, the largest of the two wagers must be placed with the front hand.

Regarding values of the various cards, any values imposed upon the cards by the casino, players, or any other governing body may be implemented, although it has been found that for ease of play, the conventional valuation system of Twenty-One is preferable. This system imposes the following values: King, Queen, Jack—10; Ace—1 or 11 depending on which value is most beneficial to the hand in play; and 2-10—their ordinary numerical value. In addition, Jokers may be given a certain value, however in the preferable method of playing Double Hand Marquez, Jokers are excluded, and a conventional 52-card deck is used.

The number of card decks used in Double Hand Marquez, as well as the number of cards dealt to each player, are limited only by the practical requirements of the game. Obviously, playing a large number of decks dealing a multitude of cards resulting in a large number of hands, would increase the betting action of each game, but would also create a game too cumbersome to practically manage. Hence, it has been found that two-hand play with five cards dealt to each player, from a maximum of up to 10 card decks, to be preferable. This combination provides excellent betting action, as well as provides a manageable card game.

In FIG. 2, a typical pair of hands in play during a game of Double Hand Marquez is illustrated. Here, the player was dealt five cards: an Ace, a Seven, two Sixes and a Three. The player chose to designate his Ace as having a value of 11 and combine it with the Seven to make a total sum of 18. The other three cards, the two Sixes and the Three, combine to make a total sum of 15. According to the rules, the two-card hand having the highest sum must be moved to the front position 20 and the three-card hand having the lower sum, must be moved to the back position 22. A second example (not shown) would be where the player is dealt a Jack, Ten, Queen, King and Ace. According to the rules, the player is required to place the Ten and the Ace in the front hand for a total of 21, and the Jack, King, and Queen in the back hand for an "over hand" totalling 30. It would not be permissible, for example, to place the Queen and King in the front hand for a total of 20 and the Ten, Jack and Ace in the back hand for a total of 21. A third example (not shown) would be where the player is dealt a Ten, Nine, Eight, Seven and Five. According to the rules, the player is required to place the Ten and Seven, or the Nine and Eight, in the front hand for a total of 17, and the Ten, Seven and Five, or the Nine, Eight and Five in the back hand (both "over hands") in the back hand for a total of 22. It would not be permissible to place the Ten and Nine in the front hand for a total of 19, and place the Eight, Seven and Five in the back hand for a total of 20.

There are times, however, when five cards are dealt and no matter how they are arranged, the three-card combination always results in a higher sum than the two-card combination. In that case, a special rule of play comes into effect. Referring to FIG. 3, a pair of hands where the three-card combination always results in a higher sum than the two-card combination is shown. Here, the player was dealt three Sevens, a Six and a Five. Two of the Sevens add up to 14 and, being the highest numbered cards, were arranged into the two-card combination and the remaining three cards were arranged into a hand having a sum of 18, which is higher than the two-card combination sum of 14. Such a hand results in only special situations and is designated a "reverse hand". In such a situation, the applicable rule in Double Hand Marquez is: the higher valued hand must be placed into the front position. Upon placing the three-card hand in the front position, normal play resumes, wherein the three-card hand in the front position is competitively wagered against the bank player's two-card hand occupying the front position. In this regard, the standard rules require the player to still make his or her two-card hand as large as possible, even though the three-card hand is being redesignated as the front hand. However, the reverse hand rule could be modified by the "house" to permit alternative combinations. For example, if the player were dealt three Sixes, a Seven and an Eight, the reverse hand rule would result in the three-card front hand comprising the three Sixes, and a two-card back hand comprising the Seven and the Eight. A modified reverse hand rule could, for example, permit the three-card front hand to comprise a Six, Seven and Eight, and the two-card back hand to comprise two Sixes.

If a player fails to arrange his best hand in the front position, the dealer or floor person rearranges the hand in the proper way according to the rules of play, and both hands are penalized as follows: if the player who made the error has a winning hand, it will be declared a tie hand, and if the player has a tie hand, it will be declared a lost hand. A losing hand obviously will lose. In a case of doubt, before putting the two hands faced down at the table (calling the hands), any player, including the bank player can ask the dealer or floor person for the proper way to arrange the hands.

The role of the bank player can be played by any player at the table or by the dealer. The bank player's purpose is to declare or "post" an amount of money or valuables which are to be risked. The risked amount is called the "bank" and it is placed in a separate position from the bank player's other money or valuables. In addition, the bank player cannot win or lose an amount greater than the amount declared by him. For example, in typical play, the direction of play moves to the left of the banker. If the bank player declares a bank in the amount of $100.00, and in proceeding left, the first player has two bets of $10.00 each, $80.00 will remain in play; if the next player has two bets of $20.00 each, $40.00 will remain in play; if the next player has two bets of $50.00 each, this last player can only win or lose $20.00 in the front hand and $20.00 in the back hand, and all wagering action ceases with this last player, irrespective of whether there are players to the left of this last player. Hence, once the amount posted by the bank player has been met or exceeded by subsequently wagering players, all wagering ceases with the player who met or exceeded the declared bank amount.

Therefore, the possibility exists that some players to the left of the player who met or exceeded the declared bank amount will be excluded from all wagering action. To remedy this possibility, several routes toward solving this problem can be implemented.

First, the dealer can be designated as the bank player, and with the nearly unlimited resources of the gaming establishment in which he is employed behind him, the dealer can adequately cover all wagers at the table, with every hand.

Second, when a player rather than the dealer is designated the bank player, an alternative method involving constantly moving the betting action to different parts of the table, insures that all players at the table will have the opportunity to participate in the wagering against the bank player. This alternative method involves imposing two rules.

The first rule involves changing the player designated as bank player after three sets of hands have been played. The designation of bank player then moves to the first player at the original bank player's left. This player has the option of declining the designation of bank player and passing this designation to a subsequent player at his left. The only way the original bank player can bank the game for a fourth consecutive time is if all the other players decline to be designated as bank player. However, the designation of bank player creates a higher potential for gain, since the bank player is competing against all other players at the table and, if the bank player wins against all of them, substantial winnings could be garnered. The desirability of enhanced winnings naturally inspires people to exercise their option to occupy the position of bank player. If this happens, the direction of play will be constantly moved to the left around the table, and every player will get the opportunity to competitively wager against the bank player.

In addition to this first rule, a second rule can be implemented which further designates the player who has the first opportunity at the table to wager against the bank player. This rule is as follows: the cards are dealt in such a fashion that the bank player receives the last cards (e.g., the cards are dealt starting with the first player to the left of the bank player). Upon the bank player's receiving the final card of his five-card hand, the dealer turns the next card face-up in the middle of the table. The value of the card may be determined by any valuing system which is practicable, but preferably, the following values are assigned: Ace—one; 2–10—their ordinary numerical value; Jack, Queen, King—counted as eleven, twelve and thirteen, respectively. The value of the card determines the size of the count to be undertaken in determining the player who will start the wagering.

Referring again to FIG. 1, the method of implementing this additional rule is illustrated. If the bank player is player 2, the card which determines the count at which the wagering begins is a Queen, and there are seven players including the bank player at the table, the count begins with the first person (player 1) at the left of the bank player (player 2). The bank player (player 2) is logically excluded from the action counted, since the bank player cannot bet against himself. Being that the value for the Queen is 12, the count proceeds as follows: Player 1, 7, 6, 5, 4, 3, 1, 7, 6, 5, 4, 3. The count ends at player 3, the twelfth position from the start of the count, and likewise, player 3 designates the start of the wagering action which continues with the players at his left until the bank amount designated by the bank player is met or exceeded. Hence, no players will be excluded from the betting action, because the bank player constantly changes and the position where the wagering begins constantly changes.

At the beginning of Double Hand Marquez, the original bank player is determined as follows: at the beginning of the game the dealer will spread a deck of cards faced down on the table. Every player will choose one card and turn it face-up. The player with the highest card (Ace being the highest card) will have the option to be bank player. If the player with the option wishes not to bank the game, the option will pass to the next player at his left and this way successively, until someone accepts the designation of bank player. Should no one accept the option, the dealer can become the bank player and the game will proceed. As stated, the bank player has the option of banking the game for one, two or three times maximum and upon the third time being reached, the option of bank player passes to the player at the original bank player's left. The only way a bank player can bank a game for a fourth or more consecutive times is if all other players decline to bank the game. Should the bank player bank the game for a fourth consecutive time, the following special rule applies if only one card deck is being used: a cutting button is placed in front of the player seated at the left of the bank player and the cutting button is moved to the left with every hand, to avoid the same player cutting the single card deck each time.

To illustrate the previously discussed rules of Double Hand Marquez being applied to an actual round of play, FIG. 1 is again referred to for purposes of this discussion. The first step is to choose a bank player by having the dealer spread out a deck of cards face-down and allowing each player to choose one card. The player with the highest card is designated as the original bank player, and in FIG. 1, player 2 occupies this position. Once the bank player has been chosen, the players place their two bets, with the highest bet for each player being placed at the front position 20. At the same time, the other players are placing their bets, the bank player designates an amount he wishes to risk against the other players. Next, the cards are cut by the player directly to the right of the bank player (player 3) and five cards are dealt to each player, starting with the player directly to the left of the bank player (player 1), and finally ending with player 2, the bank player.

After the dealer has dealt the bank player all his cards, a final card is turned face-up in the middle of the table. The value of this card determines the size of the count necessary to determine the player at which the action begins. If, in FIG. 1, the value of the card is four, the count starts with the first player (player 1) to the left of the bank player (player 2), proceeding four places to player 5.

After the players have arranged their five cards into a front and back hand according to the rules herein, player 5 establishes the position at which the cards are first played against the bank player's front and back hands. After that first set of hands are played against the bank player, the play continues in a direction to the left of player 5 until the cumulative wagers of the players meet or exceed the bank amount initially designated by the bank player. Wagering ceases at the player who meets or exceeds the amount designated by the bank player.

In determining winning or losing hands, the front hand of a player is always compared with the front hand of the bank player. Similarly, the back hands the player and bank player are always compared. When comparing front hands, the hand which comes closest to or equals twenty one will win that hand, except in the case of a tie. When comparing back hands, the hand which equals twenty-one or comes closest to twenty one without going over, wins the hand except in the case of a tie. Also, any back hand which has a value of twenty one or less will win when compared to a back hand of the bank player which exceeds twenty one. And, any back hand which exceeds twenty one will tie the back hand of the bank player which exceeds twenty one.

Accordingly, it will be seen that this invention provides a variation of the card game twenty-one where players competitively wager multiple hands simultaneously against the multiple hands of a bank player. This variation of twenty one increases the number of hands in play compared to conventional twenty-one, and likewise, increases the amount of wagering occurring at any one time. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method of playing a card game, comprising the steps of:

(a) providing at least one deck of playing cards;

(b) establishing numerical values for each card in said deck;

(c) dealing a plurality of cards to a player and a bank player, said player and said bank player being dealt the same number of cards;

(d) said player and said bank player each arranging its cards into a first hand and a second hand, said first hand containing one less card than said second hand, each said hand having a numerical sum;

(e) said cards in each said hand being arranged to produce a hand having a numerical sum that is closest to, without going over, twenty one;

(f) said cards in each said hand being further arranged such that said first hand comprises a hand having numerical value close to twenty-one without exceeding twenty one than said second hand;

(g) comparing the numerical sum of said player's first hand with the numerical sum of said bank player's first hand, with the highest numerical sum not exceeding twenty one winning said first hand; and (h) comparing the numerical sum of said player's second hand with the numerical sum of said bank player's second hand, with the highest numerical sum not exceeding twenty one winning said second hand.

2. A method as recited in claim 1, further comprising the steps of:

(a) selecting said bank player according to an established criteria;

(b) said bank player declaring an amount to cover said wagers of said player;

(c) said player placing a separate wager for said first hand and said second hand; and (d) said player collecting said wager from said bank player for a winning hand, said player paying said wager to said bank player for a losing hand, the cumulative amount collected by said player or paid to said bank player not exceeding the amount declared by said bank player to cover said wagers.

3. The method as recited in claim 2, wherein selection of said bank player comprises the steps of allowing a plurality of players to each choose a single card from said deck having a numerical value, and designationg the player having the card with the highest numerical value to be the bank player.

4. The method as recited in claim 3, wherein said bank player, upon being designated as such, has the option of passing said designation of said bank player to another player.

5. The method as recited in claim 4, wherein said bank player, upon exercising its option to be designated as such, has an additional option of banking said game for up to three times maximum.

6. The method as recited in claim 5, wherein said bank player may bank said game for a fourth, or more times, if all other players decline their option to be designated as bank player.

7. The method as recited in claim 1, wherein five cards are dealt to said player and five cards are dealt to said bank player.

8. The method as recited in claim 7, wherein said first hand comprises a front hand having two cards, and said second hand comprises a back hand having three cards.

9. The method as recited in claim 8, wherein said cards must be arranged to maximize the numerical sum of the cards in said front hand without exceeding twenty-one.

10. The method as recited in claim 9, wherein if said cards have numerical values such that, regardless of their arrangement, the numerical sum of the cards in said back hand does not exceed twenty one but exceeds the numerical sum of the cards in said front hand, said front and back hands are reversed.

11. The method as recited in claim 10, wherein if a player fails to arranges its cards so as to maximize the numerical sum of the cards in said front hand without exceeding twenty one, said player is penalized as follows: if said player has a winning hand, said winning hand will be declared a tie hand, and if said player has a tie hand, said tie hand will be declared a losing hand.

12. A method of playing a multiple hand card game, comprising the steps of:

(a) providing at least one deck of playing cards comprising a conventional deck of 52 cards with no Jokers;

(b) establishing numerical values for each card in said deck, said values being Ace—1 or 11, King—10, Queen—10, Jack—10, and all other cards keeping their ordinary face value;

(c) dealing five cards to a player and five cards to a bank player;

(d) said player and said bank player each arranging their cards into a front hand having two cards, and a back hand having three cards, each said hand having a numerical sum;

(e) said cards in said front hand being arranged so as to maximize the numerical sum of said hand without exceeding twenty-one;

(f) said cards in said front hand being further arranged such that said front hand comprises a hand having a numerical value closer to twenty-one without exceeding than said back hand;

(g) comparing the numerical sum of said player's front hand with the numerical sum of said bank player's front hand, with the highest numerical sum winning said front hand; and (h) comparing the numerical sum of said player's back hand with the numerical sum of said bank player's back hand, with the highest numerical sum not exceeding twenty-one winning said second hand.

13. A method as recited in claim 12, further comprising the steps of:

(a) selecting said bank player according to an established criteria;

(b) said bank player declaring an amount to cover said wagers of said player;

(c) said player placing a separate wager for said first hand and said second hand; and (d) said player collecting said wager from said bank player for a winning hand, said player paying said wager to said bank player for a losing hand.

14. The method as recited in claim 13, wherein selection of said bank player comprises the steps of allowing a plurality of players to each choose a single card from said deck having a numerical value, and designationg the player having the card with the highest numerical value to be the bank player.

15. The method as recited in claim 14, wherein said bank player, upon being designated as such, has the option of passing said designation of said bank player to another player.

16. The method as recited in claim 15, wherein said bank player upon exercising its option to be designated as such, has an additional option of banking said game for up to three times maximum.

17. The method as recited in claim 16, wherein said bank player may bank said game for a fourth, or more times, if all other players decline their option to be designated as bank player.

18. The method as recited in claim 12, wherein if said cards have numerical values such that, regardless of their arrangement, the numerical sum of the cards in said back hand does not exceed twenty one but exceeds the numerical sum of the cards in said front hand, said front and back hands are reversed.

19. The method as recited in claim 18, wherein if a player fails to arranges its cards such so as to maximize the numerical sum of the cards in said front hand without exceeding twenty one, said player is penalized as follows: if said player has a winning hand, said winning hand will be declared a tie hand, and if said player has a tie hand, said tie hand will be declared a losing hand.

20. A method of playing a multiple hand, multiple action card game, comprising the steps of:

(a) providing at least one deck of playing cards comprising a conventional deck of 52 cards with no Jokers;

(b) establishing numerical values for each card in said deck, said values being Ace—1 or 11, King—10, Queen—10, Jack—10, and all other cards keeping their ordinary face value;

(c) selecting a bank player from a plurality of players;

(d) said bank player posting an amount to cover wagers of said players;

(e) each said player placing a separate wager for a front hand and a back hand;

(f) dealing five cards to each of said players, including said bank player;

(g) said players, including said bank player, arranging their cards into a front hand having two cards, and a back hand having three cards, each said hand having a numerical sum;

(h) said cards in said front hand being arranged to maximize the numerical sum of hand without exceeding twenty-one;

(i) said cards in said front hand being further arranged such that said front hand comprises a better hand than said hand having a numerical value closer to twenty-one without exceeding twenty-one (j) reversing said front hand and said back hand in the event that a player's cards have numerical values such that, regardless of their arrangement in said front hand, the numerical sum of the cards in said back hand does not exceed twenty one but exceeds the numerical sum of the cards in said front hand;

(k) comparing the numerical sum of a player's front hand with the numerical sum of said bank player's front hand, with the highest numerical sum winning said front hand;

(l) comparing the numerical sum of a player's back hand with the numerical sum of said bank player's back hand, with the highest numerical sum not exceeding twenty-one winning said second hand; and (m) said player collecting its wager from said bank player for a winning hand, said player paying its wager to said bank player for a losing hand.

* * * * *